US011233347B2

(12) United States Patent
Plate et al.

(10) Patent No.: US 11,233,347 B2
(45) Date of Patent: Jan. 25, 2022

(54) PLUG CONNECTOR ASSEMBLY

(71) Applicant: Kostal Kontakt Systeme GmbH, Luedenscheid (DE)

(72) Inventors: Herbert Plate, Luedenscheid (DE); Manuel Blauscheck, Herscheid (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 16/922,101

(22) Filed: Jul. 7, 2020

(65) Prior Publication Data

US 2020/0335894 A1 Oct. 22, 2020

Related U.S. Application Data

(63) Continuation of application No. PCT/EP2019/050648, filed on Jan. 11, 2019.

(30) Foreign Application Priority Data

Jan. 12, 2018 (DE) ..... 10 2018 000 204.8

(51) Int. Cl.
*H01R 12/57* (2011.01)
*H01R 12/71* (2011.01)
(Continued)

(52) U.S. Cl.
CPC ..... *H01R 12/716* (2013.01); *H01R 12/57* (2013.01); *H01R 12/585* (2013.01);
(Continued)

(58) Field of Classification Search
CPC .... H01R 12/716; H01R 12/57; H01R 12/585; H01R 12/707; H01R 12/75;
(Continued)

(56) References Cited

U.S. PATENT DOCUMENTS 5,533,908 A 7/1996 Henry et al.
6,315,600 B1 * 11/2001 Droesbeke ..... H01R 13/5825 439/368
(Continued)

FOREIGN PATENT DOCUMENTS

CN 201130767 Y 10/2008
CN 103427236 A 12/2013
(Continued)

OTHER PUBLICATIONS

European Patent Office, International Search Report for International Application No. PCT/EP2019/050648, dated Mar. 14, 2019.
(Continued)

*Primary Examiner* — Truc T Nguyen
(74) *Attorney, Agent, or Firm* — Brooks Kushman P.C.

(57) ABSTRACT

A plug connector assembly includes first and second plug connector parts. The first plug connector part is arranged on a printed circuit board (PCB) and includes first contact elements. The second plug connector part includes a base body and second contact elements held by the base body. The first and second contact elements are connected when the first and second plug connector parts are connected. Stamped/bent parts are positioned on respective sides of the first plug connector part and are connected to the PCB. When the plug connector parts are fully connected, an electrical connection is established between at least one stamped/bent part and a contact element of the second plug connector part, or alternatively, an electrical connection is established between the two stamped-bent parts. The electrical connections in each case are suitable for electronically recognizing and/or monitoring the connection of the plug connector parts.

13 Claims, 5 Drawing Sheets

(51) Int. Cl.
*H01R 12/58* (2011.01)
*H01R 12/70* (2011.01)
*H01R 12/75* (2011.01)
*H01R 13/627* (2006.01)

(52) U.S. Cl.
CPC ..... *H01R 12/707* (2013.01); *H01R 12/75* (2013.01); *H01R 13/6275* (2013.01)

(58) Field of Classification Search
CPC ..... H01R 13/6275; H01R 13/7033; H01R 12/724; H01R 12/58; H01R 12/7005; H01R 13/641
See application file for complete search history.

(56) References Cited

U.S. PATENT DOCUMENTS

| | | | | |
|---|---|---|---|---|
| 7,285,004 | B1 * | 10/2007 | Fukuda | H01R 13/6272 439/354 |
| 8,845,355 | B2 * | 9/2014 | Litowitz | H01R 13/443 439/357 |
| 11,131,989 | B2 * | 9/2021 | Cella | G05B 23/0297 |
| 11,133,622 | B2 * | 9/2021 | Misu | H01R 13/639 |
| 2004/0166717 | A1 * | 8/2004 | Muro | H01R 13/6272 439/358 |
| 2008/0038963 | A1 * | 2/2008 | Hirokawa | H01R 24/64 439/676 |
| 2009/0023340 | A1 * | 1/2009 | Zhu | H01R 13/70 439/620.17 |
| 2009/0098772 | A1 | 4/2009 | Qin et al. | |
| 2013/0316592 | A1 | 11/2013 | Yu et al. | |
| 2015/0064958 | A1 | 3/2015 | Katayanagi | |
| 2015/0295364 | A1 | 10/2015 | Ueda | |

FOREIGN PATENT DOCUMENTS

| | | | |
|---|---|---|---|
| CN | 104348025 | A | 2/2015 |
| CN | 204179274 | U | 2/2015 |
| CN | 104426003 | A | 3/2015 |
| CN | 104979719 | A | 10/2015 |
| DE | 202014010971 | U1 | 2/2017 |
| JP | 2003059589 | A | 2/2003 |
| WO | 2008150523 | A2 | 12/2008 |

OTHER PUBLICATIONS

German Patent and Trademark Office, German Search Report for German Patent Application No. DE 10 2018 000 204.8, dated Aug. 29, 2018.

The International Bureau of WIPO, International Preliminary Report on Patentability for International Application No. PCT/EP2019/050648 dated Jul. 14, 2020.

The State Intellectual Property Office of People's Republic of China, 1st Chinese Office Action with English translation for Chinese Patent Application No. 201980008127.9 dated Apr. 1, 2021.

The State Intellectual Property Office of People's Republic of China, The Chinese Supplementa Search for Chinese Patent Application No. 2019800081279 dated Sep. 29, 2021.

The State Intellectual Property Office of People's Republic of China, The Chinese First Search of Chinese Patent Application No. 2019800081279 dated Mar. 24, 2021.

* cited by examiner

PLUG CONNECTOR ASSEMBLY

CROSS-REFERENCE TO RELATED APPLICATIONS

This application is a continuation of International Application No. PCT/EP2019/050648, published in German, with an International filing date of Jan. 11, 2019, which claims priority to DE 10 2018 000 204.8, filed Jan. 12, 2018; the disclosures of which are hereby incorporated in their entirety by reference herein.

TECHNICAL FIELD

The present invention relates to a plug connector assembly having first and second plug connector parts, the first plug connector part situated on a printed circuit board and including first contact elements, the second plug connector part including a base body and second contact elements held by the base body, the second plug connector part being connectable to the first plug connector part, and the second contact elements being electrically and mechanically connected to the first contact elements when the first and second plug connector parts are connected.

BACKGROUND

Such plug connector assemblies are known in many designs. The first contact elements of the first plug connector part are often connected electrically as well as mechanically to the printed circuit board (PCB). This connection of the first contact elements to the PCB may be achieved, for example, by inserting end sections of the first contact elements into recesses in the PCB and subsequently soldering the end sections to printed conductors of the PCB.

In such plug connector assemblies, the first and second plug connector parts must be connectable in a simple and functionally reliable manner. In particular, it should be possible to reliably prevent the two plug connector parts from being inadvertently disconnected. For this purpose, locking elements are known which are implemented, for example, by displaceable housing parts of the plug connector parts.

In addition, a monitoring option is often desired which allows a determination of whether the first and second plug connector parts are correctly connected to one another.

To this end, it may be provided, for example, for contact elements of one plug connector part to be electrically bridged via contact elements of the other plug connector part. This may then be queried and recognized by an electronics system. It is disadvantageous that such querying requires at least one additional conduction path via a connection of the first and second contact elements, as the result of which the plug connector assembly must have correspondingly large dimensions. It is particularly disadvantageous that due to such a short-circuit bridge, based on tolerances an established plug-in connection is reported before the plug connector parts have reached their final connection position. Thus, recognition of whether the connection of the plug connector parts is completely and correctly established is not ensured.

SUMMARY

An object is to provide a plug connector assembly having a first plug connector part situated on a printed circuit board (PCB) and a second plug connector part for which a complete connection of the plug connector parts may be determined in a particularly simple and reliable manner.

At least one of the above and/or other objects is achieved, firstly, in that a pair of stamped/bent parts are positioned next to respective sides of the first plug connector part and are fastened to the PCB, each stamped/bent part forming a movable spring arm, and when the plug connector parts are fully connected, a section of at least one of the spring arms engages with a detent recess on a base body of the second plug connector part thereby establishing an electrical connection with a second contact element held by the base body.

At least one of the above and/or other objects is achieved, secondly, in that a pair of stamped/bent parts are positioned next to respective sides of the first plug connector part and are fastened to the PCB and a metallic connecting element is situated on a base body of the second plug connector part, and the metallic connector element electrically connects the stamped/bent parts to one another via two spring arms when the plug connector parts are fully connected together, the spring arms being integrally formed in one piece either on the stamped/bent parts or on the connecting element.

Both approaches provide stamped/bent parts that are fastened on the PCB, and that may establish mechanical connections with the second plug connector part via spring arms. In the first approach according to embodiments of the present invention, when the plug connector parts are completely connected, spring arms of the stamped/bent parts engage with detent recesses on the base body of the second plug connector part, and at the same time thus establish at least one electrical connection with contact elements of the second plug connector part. The second approach according to embodiments of the present invention provides a metallic connecting element that electrically connects the two stamped-bent parts to one another via spring arms when the plug connector parts are fully connected, which allows the correct connection of the plug connector parts to be easily checked and monitored.

Herein, the term "stamped/bent part" is to be understood in a broad sense as a sheet metal part formed by stamping, and that has at least one section bent at a right angle or approximately a right angle. It is irrelevant whether the bending takes place at the same time as the stamping or in a subsequent work step.

The fastening of the stamped/bent parts to the PCB may take place, for example, via press-in zones which are integrally formed on angularly molded-on fastening strips of the stamped/bent parts. The fastening strips preferably form simple soldering surfaces that are soldered to contact surfaces or printed conductors on the surface of the PCB.

The engagement of the spring arms with the detent recesses in the base body of the second plug connector part also allows, in a particularly simple manner, secure mechanical fixing of the second plug connector part to the PCB, and also at the same time, to the first plug connector part situated on the PCB. It is advantageous that no detent elements are necessary on the first plug connector part.

For the attached state of the second plug connector part to the PCB, a further option for electrical or electronic monitoring may be provided by attaching a simply shaped metallic connecting element to the base body of the second plug connector part. The stamped/bent parts are electrically connected to one another via the connecting element by spring arms. The spring arms may be designed either as sections of the stamped/bent parts or as sections of the connecting element.

Since in any case an arrangement of the two stamped/bent parts on the surface of the PCB is provided, hardly any additional effort is necessary to also electrically connect the stamped-bent parts to printed conductors of the PCB. The test of whether a plug-in connection is correctly established may thus be based on a simple query that determines whether an electrical connection exists between two oppositely situated stamped-bent parts. This test may take place using a simple electronics system that is situated on or connected to the PCB, and which is not described in greater detail here.

For this purpose, it is advantageous that no contact elements of the two plug connector parts have to be assigned, and also that no additional connecting lines are required.

It is particularly advantageous that for highly safety-relevant control systems, for example in cameras or sensors in autonomously driving motor vehicles, the existence of the connection of the plug connector parts may be continuously monitored without having to increase the number of poles or the installation size of the plug connector parts.

BRIEF DESCRIPTION OF THE DRAWINGS

Three exemplary embodiments of the present invention are explained in greater detail below with reference to the drawings, which show the following.

DETAILED DESCRIPTION

Figure 1:
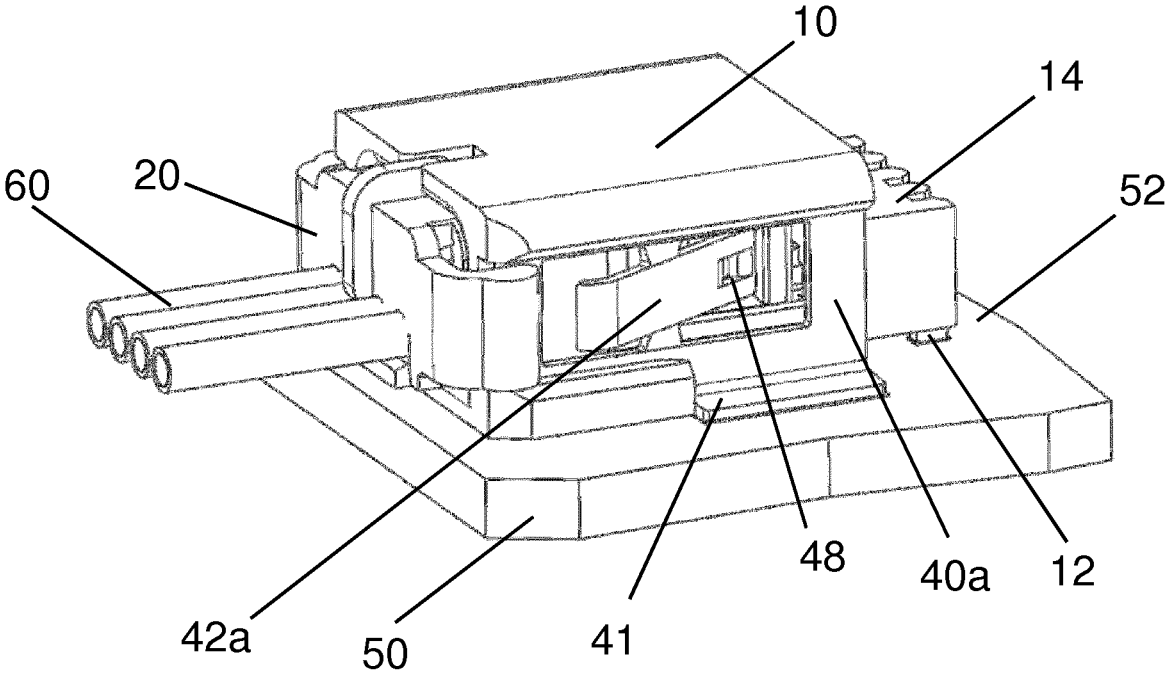
FIG. 1 illustrates a first plug connector assembly in accordance with a first exemplary embodiment of the present invention.
Figure 2:
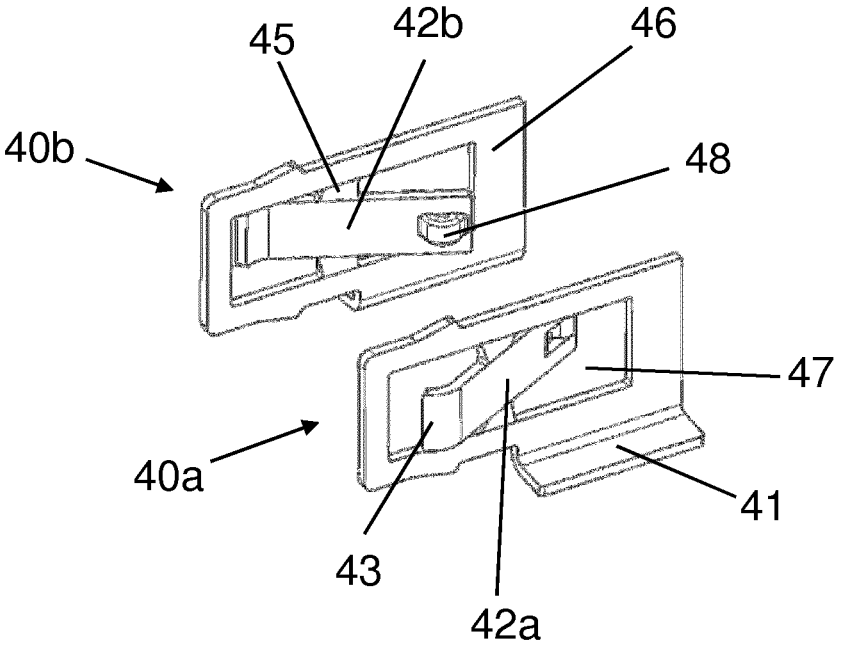
FIG. 2 illustrates stamped/bent parts of the first plug connector assembly.

Detailed embodiments of the present invention are disclosed herein; however, it is to be understood that the disclosed embodiments are merely exemplary of the present invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Referring now to FIGS. 1, 2, 3, and 4, a first plug connector assembly in accordance with a first exemplary embodiment of the present invention is shown. The first plug connector assembly includes a first plug connector part 10, a second plug connector part 20, a printed circuit board (PCB) 50, a first stamped/bent part 40*a*, and a second stamped/bent part 40*b*.

First plug connector part 10 is arranged or situated on and/or connected to PCB 50. First plug connector part 10 includes first contact elements 12 and a contact carrier 14. First contact elements 12 are held by contact carrier 14. First contact elements 12 are connected electrically and mechanically to PCB 50. Second plug connector part 20 includes second contact elements 22 and a base body 30. Second contact elements 22 are held by base body 30. First and second plug connector parts 10, 20 are connectable together. First and second contact elements 12, 22 are electrically and mechanically when plug connector parts 10, 20 are connected together.

Base body 30 of second plug connector part 20 has detent recesses (or notches) 32*a*, 32*b* on respective sides of the base body. Respective second contact elements 22 of second plug connector part 20 adjacent to detent recesses 32*a*, 32*b* are accessible from the external environment through the respective detent recesses.

Stamped/bent (or punched/bent) parts 40*a*, 40*b* are positioned next to respective first and second sides of first plug connector part 10. Stamped/bent parts 40*a*, 40*b* are fastened to PCB 50. Stamped/bent parts 40*a*, 40*b* form respective first and second spring arms 42*a*, 42*b*. Spring arms 42*a*, 42*b* are movable in one-piece in parallel to surface 52 of PCB 50. Spring arms 42*a*, 42*b* have a respective contact flange 48 thereon. When plug connector parts 10, 20 are connected together, contact flanges 48 on spring arms 42*a*, 42*b* engage in respective detent recesses 32*a*, 32*b* in base body 30 of second plug connector part 20, thus fixing second plug connector part 20 relative to PCB 50 and thus also relative to first plug connector part 10.

FIG. 1 shows first plug connector part 10 situated on PCB 50 and connected to second plug connector part 20. Multiple connecting lines 60, which are electrically individually connected to second contact elements 22 of second plug connector part 20, lead out from second plug connector part 20.

In addition to plug connector parts 10, 20, also apparent in FIG. 1 is one of two stamped/bent parts 40*a*, 40*b*. Stamped/bent parts 40*a*, 40*b* are illustrated together in FIG. 2 as individual parts. The two stamped-bent parts 40*a*, 40*b* have a mirror-symmetrical design relative to one another. In each case, stamped/bent parts 40*a*, 40*b* have a vertical frame section 46 in which rectangular spring arms 42*a*, 42*b* is in each case situated in a rectangular recess 47. At its upper edge and lower edge, each spring arm 42*a*, 42*b* is connected to frame section 46 via a short, narrow metal strip 45, and is thus supported so that it is pivotable with respect to frame section 46. Each stamped/bent part 40*a*, 40*b* on the bottom side of its frame section 46 has a narrow fastening strip 41 that is bent at a right angle with respect to frame section 46.

In addition, as noted above, stamped/bent parts 40*a*, 40*b* on their respective spring arms 42*a*, 42*b* have a protrusion, referred to as a contact flange 48. Contact flanges 48 are integrally formed on spring arms 42*a*, 42*b*.

When the first plug connector assembly is installed, fastening strips 41 of stamped/bent parts 40*a*, 40*b* rest on surface 52 of PCB 50 and are used to fasten the stamped/bent parts to the PCB. For this purpose, fastening strips 41 of stamped/bent parts 40*a*, 40*b*, similarly to electronic SMD (surface-mount device) components, are preferably soldered to contact surfaces or printed conductors (not shown) on surface 52 of PCB 50. Alternatively, fastening strips 41 on their bottom side may have press-fit zones (not shown) and may be inserted into boreholes (not shown) in PCB 50.

Figure 3:
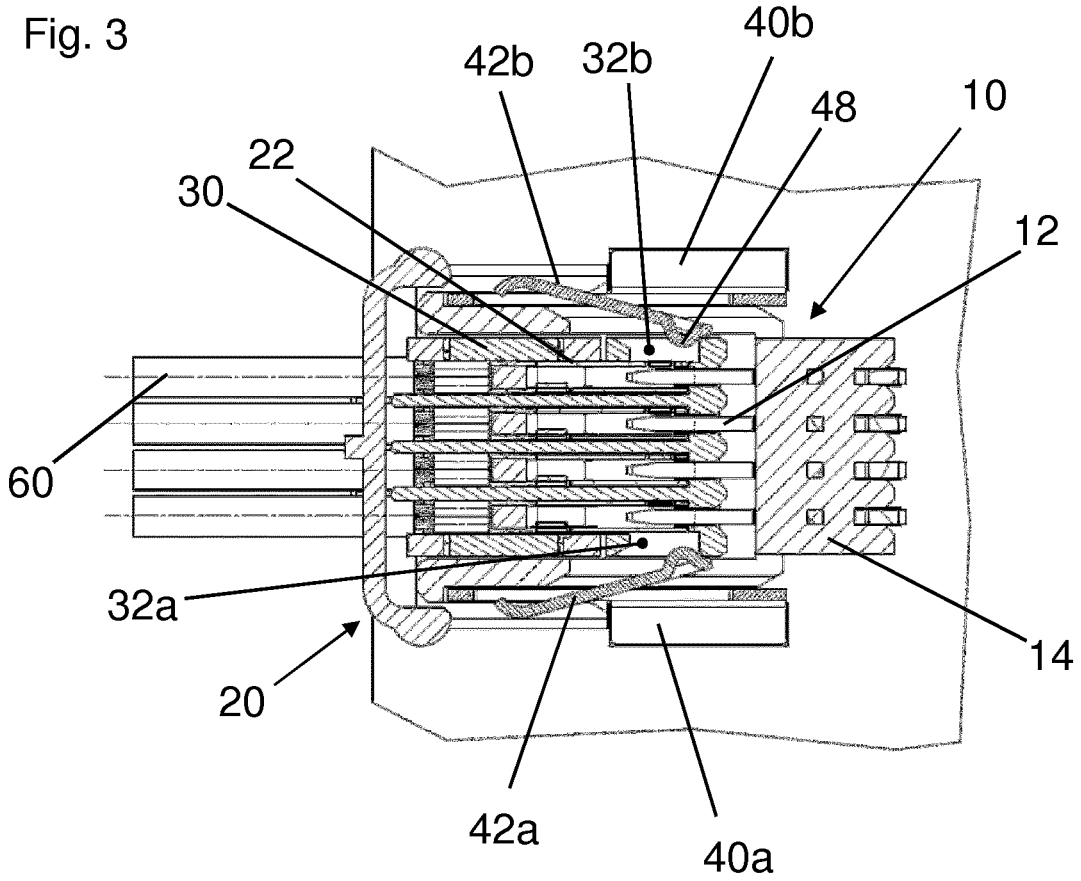
FIG. 3 illustrates a sectional view of the first plug connector assembly while in a first connection state.
Figure 4:
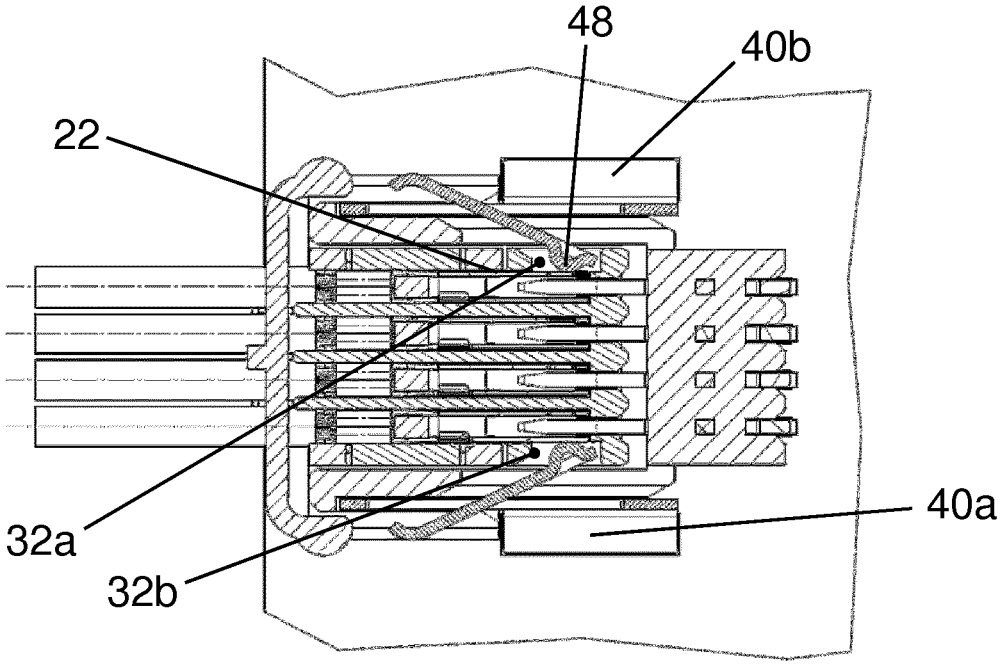
FIG. 4 illustrates a sectional view of the first plug connector assembly while in a second connection state.

FIGS. 3 and 4 illustrate the connection operation for first and second plug connector parts 10, 20 of the first plug connector assembly, in each case in a sectional view. In FIG. 3, plug connector parts 10, 20 are in a first connection state. In FIG. 4, plug connector parts 10, 20 are in a second connection state. As shown in FIGS. 3 and 4, first contact elements 12, which are part of first plug connector part 10, are held by contact carrier 14 of the first plug connector part. Contact carrier 14 may be made of plastic. Second contact elements 22, which are part of second plug connector part 20, are held by insulating base body 30 of the second plug connector part. When plug connector parts 10, 20 are connected together, which is the case in FIGS. 3 and 4, front end sections of first contact elements 12 are inserted into second contact elements 22. Second contact elements 22 are electrically connected to connecting lines 60 leading out of second plug connector part 20. As shown in FIGS. 3 and 4, first contact elements 12 may be designed as flat plugs and second contact elements 22 may be designed as push-on sleeves.

Base body 30 of second plug connector part 20 has detent (or latching) recess 32*a*, 32*b* on each of its two side faces, respectively, in parallel to second contact elements 22. When plug connector parts 10, 20 are completely connected together, respective contact flanges 48 on spring arms 42*a*, 42*b* of stamped/bent parts 40*a*, 40*b*, which functionally form mechanical detent hooks, are respectively deflected into detent recesses 32*a*, 32*b* of base body 30. Since stamped/bent parts 40*a*, 40*b* are fixedly mechanically connected to PCB 50, second plug connector part 20 is fixed relative to PCB 50 and also relative to first plug connector part 10 via spring arms 42*a*, 42*b*.

In the first connection state shown in FIG. 3, first and second plug connector parts 10, 20 are not yet fully or completely connected. Although contact elements 12, 22 of plug connector parts 10, 20 are already joined together here, their intended complete connecting position has not yet been attained. Contact flanges 48 on spring arms 42*a*, 42*b* of stamped-bent parts 40*a*, 40*b* are still in front of their locking positions in detent recesses 32*a*, 32*b* on base body 30 of second plug connector part 20.

In the second connection state shown in FIG. 4, first and second plug connector parts 10, 20 are fully or completely connected. After plug connector parts 10, 20 are fully connected, contact flanges 48 on spring arms 42*a*, 42*b* are engaged with detent recesses 32*a*, 32*b* on base body 30 of second plug connector part 20. As a result, contact flanges 48 at the same time physically contact or rest against sections of respective second contact elements 22 of second plug connector part 20 that are accessible through detent recesses 32*a*, 32*b*. The electrical connection thus established between stamped/bent parts 40*a*, 40*b* and second contact elements 22 may be detected by an electronics system and evaluated for recognizing and/or monitoring a complete connection between plug connector parts 10, 20. For this purpose, the electronics system checks, for example, the potentials or signal patterns, present at second contact elements 22 connected to stamped/bent parts 40*a*, 40*b*, for plausible values.

The purpose of contact flanges 48, which are integrally formed on spring arms 42*a*, 42*b*, is to establish a particularly good electrical connection with metallic contact elements 22, and at the same time, to form mechanical detent hooks on spring arms 42*a*, 42*b*.

As mentioned above, when plug connector parts 10, 20 are fully connected together, contact flanges 48 on spring arms 42*a*, 42*b* of stamped/bent parts 40*a*, 40*b* are deflected into detent recesses 32*a*, 32*b*. Since stamped-bent parts 40*a*, 40*b* are fixedly mechanically connected to PCB 50, second plug connector part 20 is mechanically fixed relative to PCB 50 and also relative to first plug connector part 10 via spring arms 42*a*, 42*b*.

Inadvertent or accidental disconnection of plug connector parts 10, 20 due to falling out or being pulled out via connecting lines 60 is thus prevented. Plug connector parts 10, 20 can be disconnected from one another by simultaneously exerting pressure on actuating sections 43 of spring arms 42*a*, 42*b* which allows contact flanges 48 to be moved out of detent recesses 32*a*, 32*b* of base body 30 against the elastic force of spring arms 42*a*, 42*b*.

Figure 5:
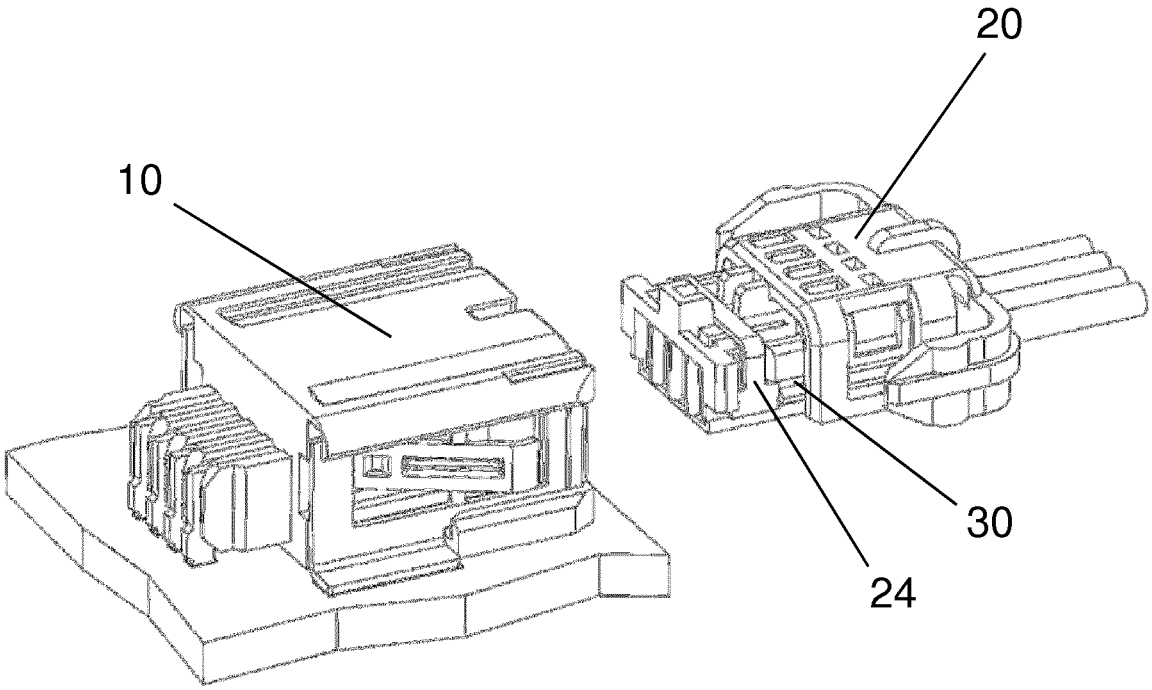
FIG. 5 illustrates a second plug connector assembly in accordance with a second exemplary embodiment of the present invention.
Figure 6:
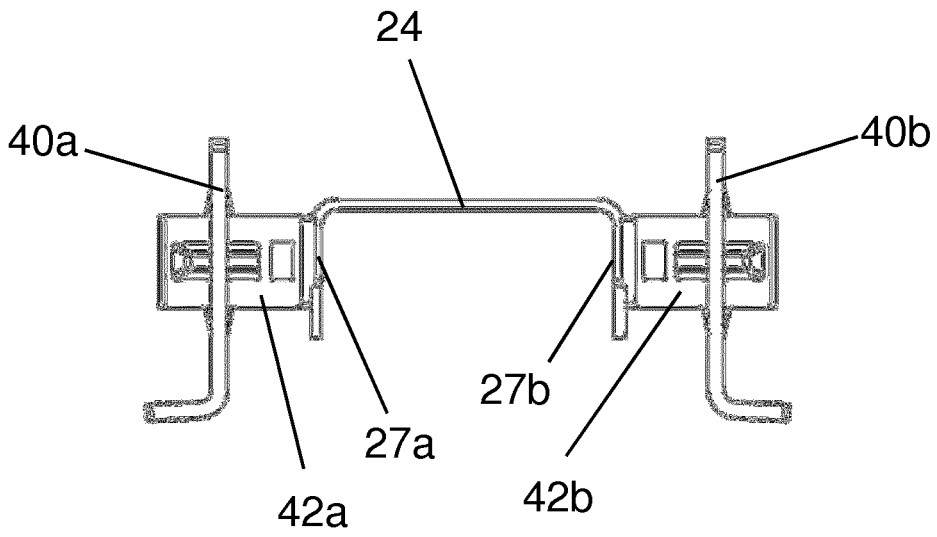
FIG. 6 illustrates a first view of electrical connecting means of the second plug connector assembly.
Figure 7:
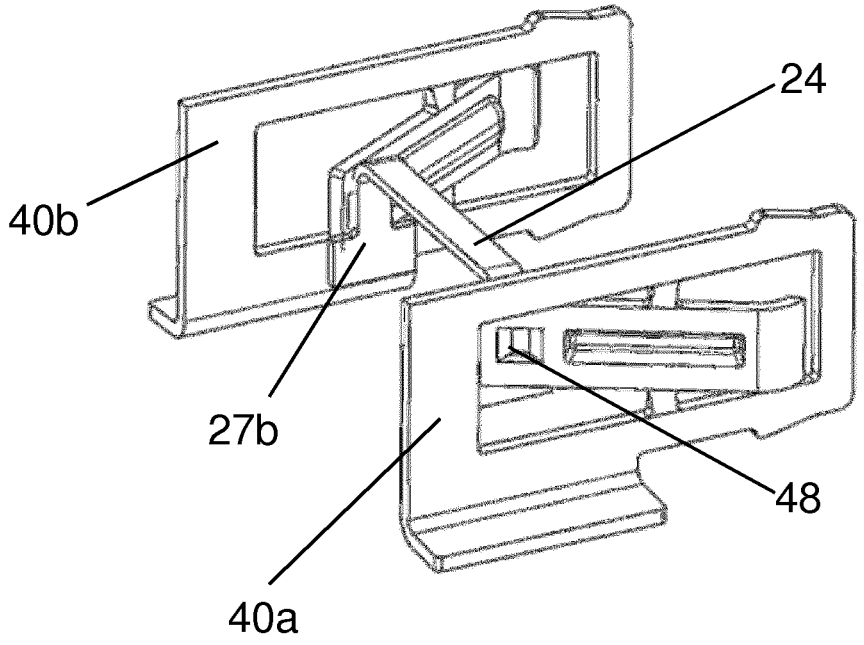
FIG. 7 illustrates a second view of electrical connecting means of the second plug connector assembly.

Referring now to FIGS. 5, 6, and 7, a second plug connector assembly in accordance with a second exemplary embodiment of the present invention will be described. For simplification and better comparability, FIGS. 5, 6, and 7 depicting the second plug connector assembly use the same reference numerals used with the description of the first plug connector assembly described with reference to FIGS. 1, 2, 3, and 4.

FIG. 5 illustrates first and second plug connector parts 10, 20 of the second plug connector assembly in the unconnected state. A difference of the second plug connector assembly compared to the first plug connector assembly is that instead of detent recesses on the base body of second plug connector part via which individual contact elements of the second plug connector part are electrically accessible from the outside, in the second plug connector assembly a metallic connecting element 24 is situated on base body 30 of second plug connector part 20.

Connecting element 24 is shown in FIGS. 5, 6, and 7 and is discernible particularly clearly in FIGS. 6 and 7. In FIGS. 6 and 7, most details of plug connector parts 10, 20 have been omitted for purposes of explanation. Connecting element 24 here has a profile in the shape of a flattened letter "U" (shown upside down FIGS. 5, 6, and 7). Connecting element 24 has two U-legs 27*a*, 27*b*.

Connecting element 24 is situated on base body 30 of second plug connector part 20, as shown in FIG. 5. Connecting element 24 spans the top side of base body 30 and its two U-legs 27*a*, 27*b* come into contact with respective side faces of base body 30.

When first and second plug connector parts 10, 20 are completely and correctly connected to one another, connecting element 24 reaches a position in which spring arms 42*a*, 42*b* of stamped/bent parts 40*a*, 40*b* rest against U-legs 27*a*, 27*b* of connecting element 24. Spring arms 42*a*, 42*b* resting against U-legs 27*a*, 27*b* of connecting element 24 establishes an electrically conductive connection between stamped/bent parts 40*a*, 40*b* via connecting element 24. This connection is illustrated in FIGS. 6 and 7 from different viewing directions.

The presence of the electrical connection may be evaluated by an electronics system. In contrast to the first exemplary embodiment, this evaluation is totally independent of the signals and potentials that are conducted by contact elements 12, 22 and connecting lines 60 of plug connector parts 10, 20.

Figure 8:
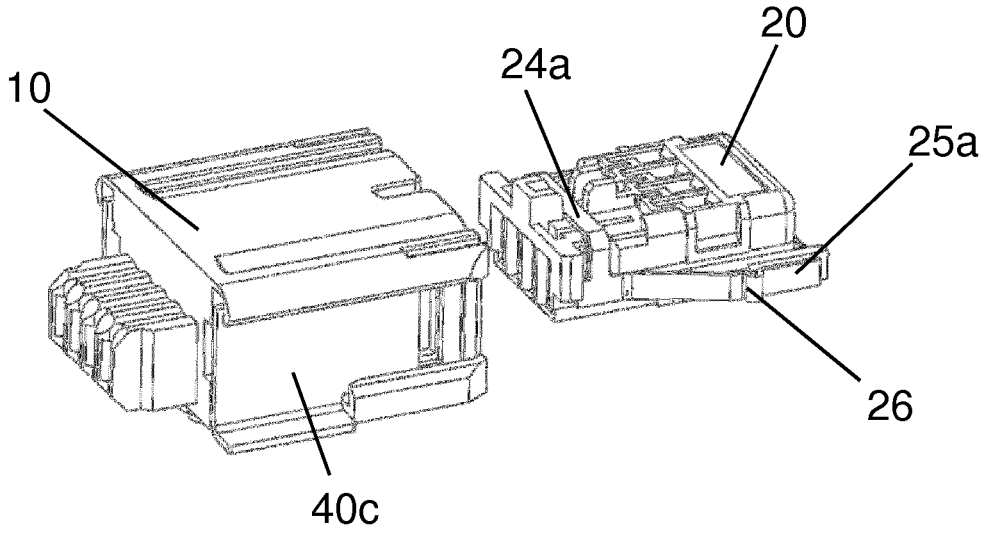
FIG. 8 illustrates a third plug connector assembly in accordance with a third exemplary embodiment of the present invention.
Figure 9:
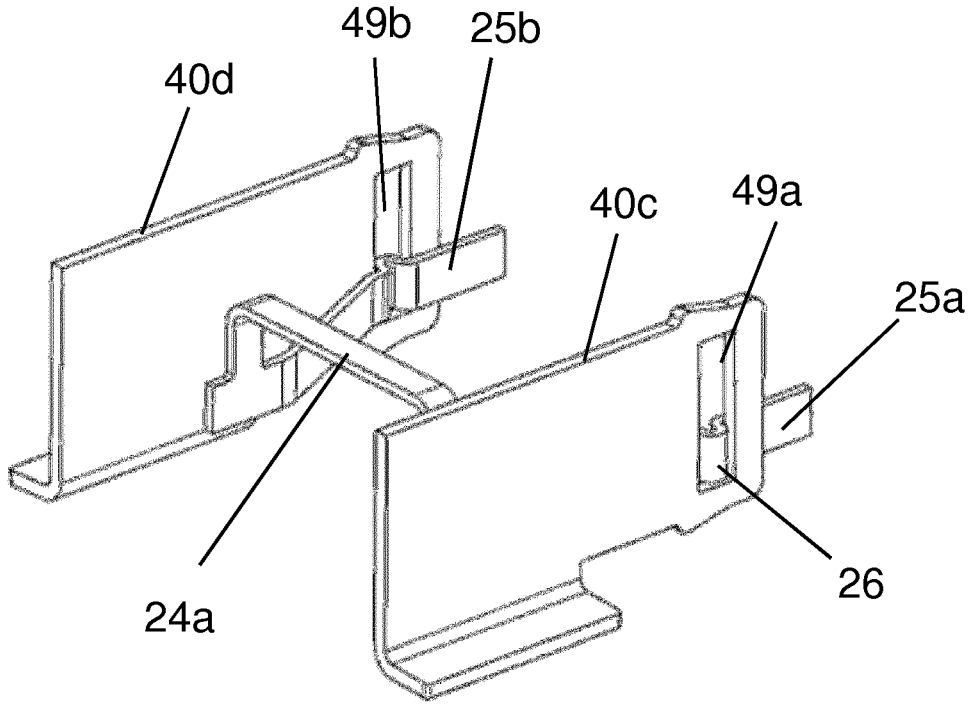
FIG. 9 illustrates electrical connecting means of the third plug connector assembly.

FIGS. 8 and 9 illustrate a third plug connector assembly in accordance with a third exemplary embodiment of the present invention. The third plug connector assembly differs from the above-described two designs in that stamped/bent parts 40*c*, 40*d* have respective recesses 49*a*, 49*b* instead of spring arms. For this purpose, spring arms 25*a*, 25*b*, each forming a bent section 26, are integrally formed on both side faces of a connecting element 24*a*. These bent sections 26 engage with detent recesses 49*a*, 49*b* in stamped/bent parts 40*c*, 40*d* when plug connector parts 10, 20 are connected.

Stamped/bent parts 40*c*, 40*d* and metallic connecting element 24*a* result here in a mechanical connection between second plug connector part 20 and PCB 50, and likewise also result in an electrically conductive connection between stamped/bent parts 40*c*, 40*d*. The electrically conductive connection between stamped/bent parts 40*c*, 40*d* is established by connecting element 24*a*, which may be evaluated for testing and monitoring a properly established and existing plug-in connection.

LIST OF REFERENCE NUMERALS

10 first plug connector part
12 first contact elements
14 contact carrier
20 second plug connector part
22 second contact elements
24, 24*a* connecting elements
25*a*, 25*b* spring arms
26 (bent) section
27*a*, 27*b* U-legs
30 base body
32*a*, 32*b* detent recesses (notches)
40*a*, 40*b*, 40*c*, 40*d* stamped-bent parts
41 fastening strip
42*a*, 42*b* spring arms
43 actuating sections
45 metal strip
46 frame section
47 recess
48 contact flange (section)
49*a*, 49*b* detent recesses
50 printed circuit board (PCB)
52 PCB surface
60 connecting lines While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A plug connector assembly comprising:

a printed circuit board (PCB);

a first plug connector part arranged on the PCB, the first plug connector part having first contact elements;

a second plug connector part having a base body and second contact elements held by the base body, the base body having a first detent recess on a side of the base body, wherein a first one of the second contact elements is adjacent to the first detent recess and is externally accessible through the first detent recess;

the first and second plug connector parts being connectable together, wherein the first and second contact elements are connected together when the first and second plug connector parts are connected together;

a first stamped/bent part positioned next to a first side of the first plug connector part and fastened to the PCB, the first stamped/bent part forming a first spring arm; and wherein when the first and second plug connector parts are connected together, a section of the first spring arm engages with the first detent recess on the base body and contacts the first one of the second contact elements thereby establishing an electrical connection between the first stamped/bent part with the first one of the second contact elements.

2. The plug connector assembly of claim 1 wherein:

the base body of the second plug connector part further having a second detent recess on another side of the base body, wherein a second one of the second contact elements is adjacent to the second detent recess and is externally accessible through the second detent recess;

the plug connector assembly further including a second stamped/bent part positioned next to another side of the first plug connector part, the second stamped/bent part being fastened to the PCB and forming a second spring arm; and wherein when the first and second plug connector parts are connected together, a section of the second spring arm engages with the second detent recess on the base body and contacts the second one of the second contact elements thereby establishing an electrical connection between the second stamped/bent part and the second one of the second contact elements.

3. The plug connector assembly of claim 2 wherein:

the sections of the first and second spring arms include respective contact flanges.

4. The plug connector assembly of claim 2 wherein:

the stamped/bent parts are fastened to the PCB by being soldered onto a surface of the PCB.

5. The plug connector assembly of claim 2 wherein:

the stamped/bent parts have press-fit zones that are inserted into boreholes in the PCB for the stamped/bent parts to be fastened to the PCB.

6. The plug connector assembly of claim 2 wherein:

the stamped/bent parts are electro-conductively connected to printed conductors of the PCB.

7. The plug connector assembly of claim 2 wherein:

the stamped/bent parts have a mirror-symmetrical design relative to one another.

8. A plug connector assembly comprising:

a printed circuit board (PCB);

a first plug connector part arranged on the PCB, the first plug connector part having a plurality of flat plug contact elements;

a second plug connector part having a base body and a plurality of push-on sleeve contact elements held by the base body;

the first and second plug connector parts being connectable together, wherein the flat plug contact elements are respectively mechanically and electrically connected to the push-on sleeve contact elements when the first and second plug connector parts are connected together;

first and second stamped/bent parts positioned next to respective sides of the first plug connector part and fastened to the PCB, the stamped/bent parts forming respective first and second spring arms, a section of the first spring arm having a first contact flange and a section of the second spring arm having a second contact flange;

a connecting element situated on the base body of the second plug connector part; and wherein only when the first and second plug connector parts are completely connected together, the connecting element reaches a position in which the contact flanges of the spring arms contact the connecting element thereby establishing an electrical connection between the stamped/bent parts via the connecting element and the spring arms whereby a presence of the electrical connection between the stamped/bent parts is detectable independent of the electrical connection between the flat plug contact elements and the push-on sleeve contact elements.

9. The plug connector assembly of claim 8 wherein: the connecting element has a U-shaped profile.

10. The plug connector assembly of claim 8 wherein: the stamped/bent parts are fastened to the PCB by being soldered onto a surface of the PCB.

11. The plug connector assembly of claim 8 wherein: the stamped/bent parts have press-fit zones that are inserted into boreholes in the PCB for the stamped/bent parts to be fastened to the PCB.

12. The plug connector assembly of claim 8 wherein: the stamped/bent parts are electro-conductively connected to printed conductors of the PCB.

13. The plug connector assembly of claim 8 wherein: the stamped/bent parts have a mirror-symmetrical design relative to one another.

* * * * *